US005486649A

United States Patent [19]

Gareis

[11] Patent Number: 5,486,649

[45] Date of Patent: Jan. 23, 1996

[54] SHIELDED CABLE

[75] Inventor: Galen M. Gareis, Richmond, Ind.

[73] Assignee: Belden Wire & Cable Company, Richmond, Ind.

[21] Appl. No.: 210,692

[22] Filed: Mar. 17, 1994

[51] Int. Cl.[6] ..... H01B 7/34

[52] U.S. Cl. ..... 174/36; 174/10; 174/34; 174/102 D; 174/108; 174/115

[58] Field of Search ..... 174/34, 36, 102 SP, 174/102 D, 107, 108, 115, 10

[56] References Cited

U.S. PATENT DOCUMENTS

| | | | |
|---|---|---|---|
| 3,379,821 | 4/1968 | Garner | 174/36 |
| 3,639,674 | 2/1972 | Stier | 174/36 |
| 3,896,261 | 7/1975 | Cole | 174/115 |
| 4,256,921 | 3/1981 | Bahder | 174/107 |
| 4,510,346 | 4/1985 | Bursh, Jr. et al. | 174/36 |
| 4,697,051 | 9/1987 | Beggs et al. | 174/36 |
| 4,803,309 | 2/1989 | Marin et al. | 174/106 R |
| 4,873,393 | 10/1989 | Friesen et al. | 174/34 |
| 5,077,449 | 12/1991 | Cornibert et al. | 174/107 |

*Primary Examiner*—Morris H. Nimmo
*Attorney, Agent, or Firm*—Laff, Whitesel, Conte & Saret

[57] ABSTRACT

A shielded cable having in the core of the cable a plurality of conductors, a lateral shield having overlapping longitudinal ends surrounding the cable core. The shield has a thickness of up to about 6 mils. A helical groove formed in the shield, and an insulating jacket surrounding the shield.

18 Claims, 16 Drawing Sheets

SHIELDED CABLE

The present invention relates to an improved shielded cable. More particularly, the present invention provides a shielded cable having a longitudinal foil shield and means to helically corrugate the foil shield.

BACKGROUND

Typical electrical shielded cables of this type have four twisted-pairs of wires surrounded by a helically wrapped shield or a longitudinally wrapped shield and a generally longitudinally extending drain wire. The various construction of known cables are illustrated in the 1993 Cooper/Belden catalog pages 52–60, 78–83, 105, 109, 110, 165–169, 240, 251, 257–260, 278. These generally show a lateral aluminum-polyester shield with a longitudinally extending overlap surrounding a plurality of insulated twisted pairs of wires. Also, the cables have a longitudinally extending drain wire. Other manufacturers are known to also use helically wound metal-polyester shields.

The problem with the prior art construction for certain types of applications is that it is difficult to produce a cable that will have sufficient flexibility and hoop strength for ease of installation such as being pulled through various conduit angles and still maintain a relatively low impedance variation throughout the length of the cable. The impedance variation is improved by providing uniform shield to conductor spacing along the length of the cable, which results in improved electrical properties along the length of the cable. The spiral drain also improves shorting at the fold.

In prior art spiral shield designs, impedance instability is brought about by a loosening of the shield where it is overlapped and a kinking of the shield when it is drawn through various types of conduits. Spiral shields tend to conform to the core elements geometry and are not nearly as geometrically stable as a lateral corrugated shield and drain. This causes the spacing of the individual conductors to the wrapped metal foil shield to vary along the cable length causing the cable electricals to vary with frequency.

Also, the spiral wrapped shields used in high frequency cables, generally must have a relatively large overlap—as much as 25% in some instances to prevent the shield from leaking. Leakage around a spiral slot creates an inductor which sets up a circumferential electrical field. This electrical field radiates interference. Leakage around a lateral or longitudinal slot radiates interference less effectively in that lit radiates generally in one plane rather than the radiation of a spiral slot which radiates as much as 360°, and as a result, does not inductively couple interference ingressively or egressively.

It is an object of the present invention to substantially reduce the problems of the prior art in cables and especially in high frequency transmission cables.

It is therefore an object of the present invention to provide a cable having a group of insulated conductors which have at least one pair of insulated conductors, a lateral shield wrapped around the group of conductors, said shield being overlapped longitudinally along the length of the cable and the shield having a metal conductor surface facing a cable jacket, a drain wire helically wrapped around the shield and being in electrical contact with the metal conductor surface of the shield, the drain wire forms a helical corrugation or groove in the shield conductor surface, and an insulator jacket covering the drain wire and the shield.

It is a specific object Of the present invention to provide a high frequency cable wherein the cable has an insulator jacket extending the length of the cable, a group of conductors which have at least one twisted pair(s) of conductors, each twisted pair of conductors having the dielectric insulating layer surrounding each conductor with the dielectric layers being joined or unjoined together along the length of the conductor, a lateral shield wrapped around the group of twisted pair conductors and extending the length of the cable, the shield having a metal conductor surface facing the jacket, the thickness of the shield being between about 0.5 to about 4.0 mils, a metal drain wire helically wrapped around the shield so as to produce spacing between each helical interval of from about 0.125 to about 0.75 inches, the drain wire providing a helical groove in the shield with the depth of the groove being at least 50% of the diameter of the drain wire and the insulating jacket is wrapped over the drain wire and shield and is optionally sized such that the outer surface of the jacket has a helical protuberance which corresponds to the contours of the helical drain wire.

Another specific object of the present invention is to provide a high frequency cable having a group of plurality of twisted pair conductors and a longitudinal drain wire laterally wrapped with a metal-plastic shield having a conducting surface facing the twisted pair conductors and a non-conducting surface facing the outer cable jacket, a non-conducting cylindrical plastic or synthetic cord helically wrapped around said shield and extending the length of the cable, the cord forms a helical groove in the shield with the helical spacing interval being between about 0.125 to about 0.75 inches, the depth of the groove being at least 50% of the diameter of the cord, the jacket is optionally sized such that the outer surface of the jacket has a helical protuberance which corresponds to the contours of the helical cord.

The present invention provides an improved cable by substituting a lateral shield having a helical groove for the shields of the prior art.

Generally, in high frequency cables, where the invention generally finds an economical and performance advantage, the shields are made of metal such as aluminum, copper and suitable metal alloys. Other metals, such as zinc may be used providing they are sufficiently flexible to form the required helical groove. The preferred shield has a conductor on one surface and a non-conductor on the opposite surface. The Beldfoil® shield of Belden Wire & Cable Company is such a shield.

The conductive surface of the metal-plastic shield is aluminum, copper, zinc, or an appropriate conductive metal alloy. The non-conductive plastic surface is generally a polyester. The thickness of the shield for high frequency cables can be from about 0.5 to about 4 mils. The preferred metal is copper or aluminum and the preferred thickness of the shield is about 1 to about 3 mils.

However, in certain applications such as electrical grade cable, an armor type shield of steel with a thickness of from about 4 to about 6 mils is contemplated.

The shield is laterally wrapped over the group of insulated conductors with the ends or sides overlapped and the overlapping ends extending longitudinally for the length of the cable.

The shield having its conductive surface facing away from the group of insulated conductors is helically wrapped with a drain wire. The wrapping is sufficiently tight to form a corresponding helical groove or corrugation in the shield. The diameter of the drain wire is from about 0.015" to about 0.050". The drain wire can be made of any appropriate material. However, it must be sufficiently strong and flexible to be wrapped around the shield, holds its configuration and provide the helical groove in the shield. The drain wire is generally made of a tinned copper. The grooves and helical portions of the drain wire are wrapped around the shield in a substantially uniform helical manner so as to provide a groove or adjacent helical loops which are spaced from about 0.125 inches to about 0.75 inches throughout the entire length of the cable.

The drain wire and the corresponding grooves hold the shield in tight contact and substantially prevent the shield from shifting or opening during its use. Therefore, the cable provides a substantially low impedance variation throughout its length.

Because of this construction, the cable can be flexed around corners without substantially changing the impedance variation. The grooves or corrugations act in a similar manner as an accordion. When the cable is bent, the grooves on the top of the bend tend to straighten out and the grooves on the underneath side compress. When the cable is straightened out the grooves go back to their normal state. This can be repeated over many flex cycles and the skill will remain in its substantially closed state due to the holding feature of the helical drain wire which provides helical loops and corresponding helical grooves spaced at predetermined intervals.

The construction of the shield substantially maintains the impedance variation at acceptable levels throughout the cable.

The cable jacket is sized such that when it is placed over the shield and helical drain wire, the jacket tightly contacts the shield portions between the drain wire helical loops and contacts the drain wire. The outer appearance of the jacket has a helical protrusion which corresponds to the helical contour of the drain wire. The jacket is the normal type of jacket used for cables, i.e., polyvinyl chloride, fluorocopolymer, Teflon, Natural Flamarrest, polyethylene, polypropylene.

The twisted pair conductors are the known conductors used for the intended purpose. The preferred twisted pair for high transmission cable is the Belden 350 which is produced by Belden Wire & Cable Company. This is a twisted pair which generally has a dielectric insulation of polyvinyl chloride, polyethylene, polypropylene and fluorocopolymers. The conductors are copper strands, solid copper, or tinned copper. Of course, other suitable conductor material may be used. The Belden 350 has the dielectric layer surrounding each conductor and being joined along the entire length of the dielectric.

DETAILED DESCRIPTION OF THE INVENTION

Figure 1:
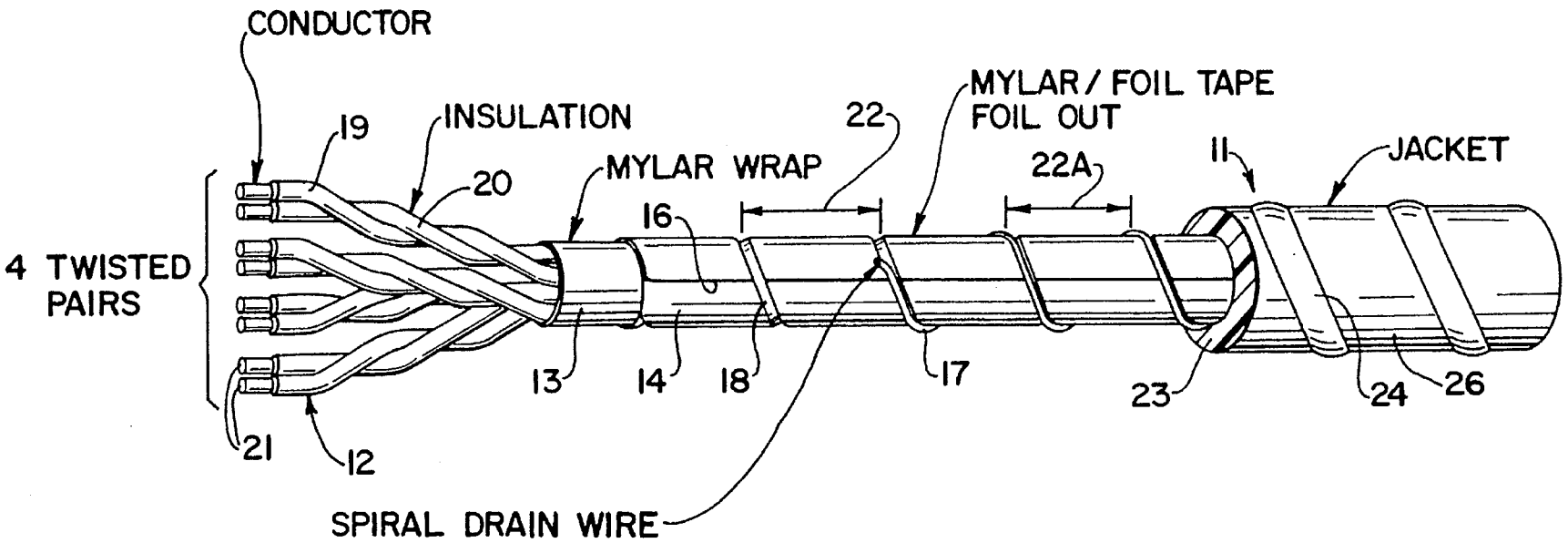
FIG. 1 is a side perspective view of the cable of the present invention.

Referring to FIG. 1, there is shown a high frequency cable 11 made according to the present,invention having four Belden Datatwist 350 twisted pair conductors 12, a plastic wrap 13 to group the conductors 12 and form a cable core, a lateral foil shield 14 having overlapping ends that extend longitudinally 16 for substantially the entire length of cable 11, a metal drain wire 17 that is helically wrapped around the shield 14 to provide a helical groove 18.

The Belden Datatwist 350 twisted pair shown each have dielectric insulation layers 19 and 20 which are joined or bonded together for the entire length of the twisted pair. The dielectric insulation may be any suitable material used in the insulation of conductors such as polyvinyl chloride compounds, polyethylene compounds, polypropylene compounds or fluorocopolymer compounds (such as Teflon, which is a registered trademark of DuPont) or natural rubber compounds. These compounds may also include a flame retardant.

Each twisted pair 12 has a pair of conductors 21. The conductors 21 may be constructed of any suitable material presently used in transmission cables or the like. The preferred material presently is the metal solid or strand conductors of copper, tinned copper, aluminum, silver, steel, known appropriate metal alloys and metal coated substrates.

The wrap 13, which is optional, may be any suitable wrapping to hold the group of twisted pair conductors 12 together. The wrap 13 is preferably a plastic wrap rather than a natural wrap. The preferred wrap as shown in the drawing is Mylar which is a registered trademark of DuPont and is identified as being a polyethylene terephthalate. The thickness of the wrap is generally from about 1 to about 2 mils.

Figure 4:
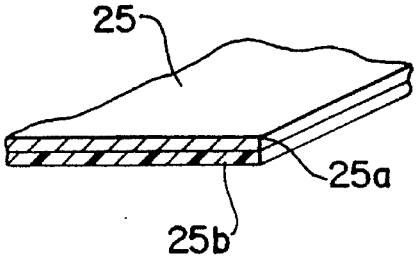
FIG. 4 is an enlarged perspective view of a composite metal foil tape in accordance with one embodiment of the invention.

The shield 14 is generally a metallic foil tape or a metal-plastic composite foil tape. The tape has a thickness of from about 0.5 to about 4 mils and preferably from about 1 to about 3 mils. The composite foil tape 25 as shown in FIG. 4 is generally prepared by laminating the metal foil 25*a* to a dielectric polymer substrate 25*b*. The metal foil 25*a* may be aluminum, copper or any of the known conductive shield material used for cables.

The shield 14 has a helical groove 18 extending the length of the shield and having groove intervals 22 of from about 0.125 to about 0.75 inches. These grooved intervals preferably are substantially uniform throughout the length of the shield.

The helically wound drain wire 17 is provided by helically winding the drain wire around the shield 14 in a sufficiently tight manner to form the helical groove 18. The groove of the drain wire provides a groove having a depth equal to at least 20% of the diameter of the drain wire and preferably at least 50% of the diameter of the drain wire 17. The drain wire 17 is generally a solid cylindrical tinned copper wire. However, it may be made of any suitable conductive material. The drain wire loops have drain wire loop intervals 22A of from about 0.125 to about 0.75 inches.

The jacket 23 is a typical cable jacket and is constructed for the intended purpose of the cable. The jacket 23 is tightly fitted over the shield 14 and drain wire 17 to provide a helical protrusion 24 which has a contour formed by the drain wire 17 and lower helical area 26 which is the area of the shield between the helical loops of the drain wire.

Figure 2:
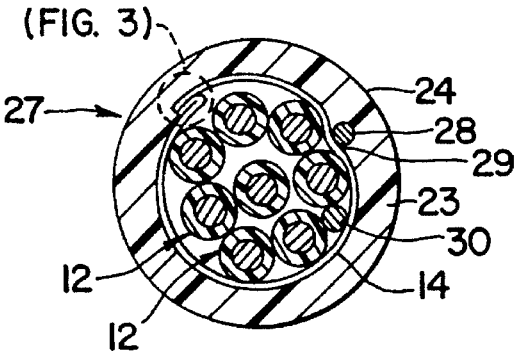
FIG. 2 is a cross-section view of another cable according to the present invention.
Figure 3:
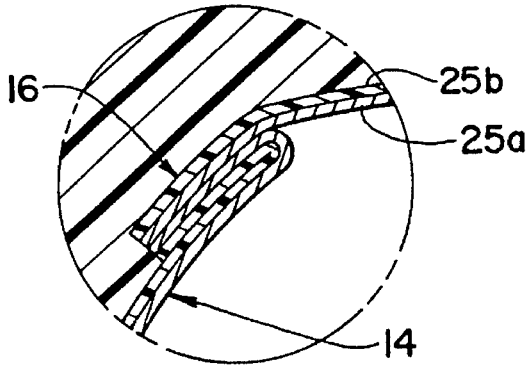
FIG. 3 is an enlarged view of a portion of FIG. 2.

FIG. 2 shows another embodiment of the present invention wherein the cable 27 has a jacket 23 with a helical protuberance 24 formed by a helically wound non-conductive dielectric cord 28 which extends the length of the lateral shield 14 which has longitudinally extending overlapping ends 16 (FIG. 3). The core of the cable is composed of four twisted pair conductors 12. When the shield is a composite shield 25 as shown in FIG. 4, the conductive surface 25*a* faces the twisted pair conductors 12 and the nonconductive surface 25*b* faces the jacket 23. A helical groove 29 is formed in the shield 14 by the cord 28. The groove 29 extends the length of the shield and has a depth at least 20% of the diameter of the cord 28 and preferably at least 50% of the diameter of the cord.

Figure 5:
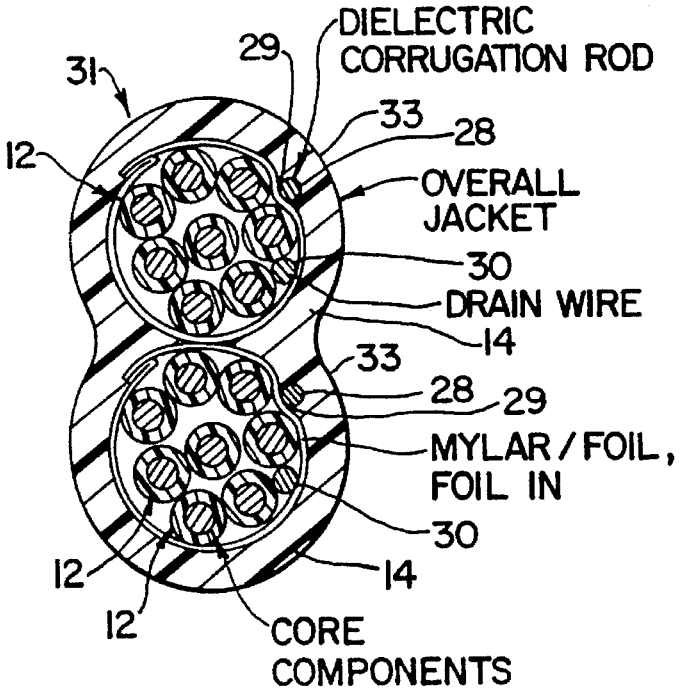
FIG. 5 is an enlarged cross-sectional view of another embodiment of the present invention.

FIG. 5 shows still another embodiment of the present invention wherein there is a cable 31 having two groups of four twisted pair conductors 12. Each group is wrapped by the lateral shield 14 and has an internal drain wire 30. A dielectric cord 28 is helically wound around each shield 14 for the entire length thereof and provides a helical groove 29 on each shield. Surrounding both shields is a common jacket 32 made of the same material as jacket 23. Jacket 32 has protuberances 33 formed by the corresponding cords 28.

In FIGS. 2 and 5, the drain wire 30 extends the entire length of the shield 14 and is within the cable core and contacts the conductive surface of the shield. Thus, in FIG. 5, when the shield is the composite shield 25, the conductive surface 25*a* faces the conductors 12.

In FIGS. 2 and 5, the dimensions of the grooves 29 and the intervals between the grooves is the same. That is, the intervals between the grooves are substantially uniform and are from about 0.125 to about 0.75 inches.

Figure 6:
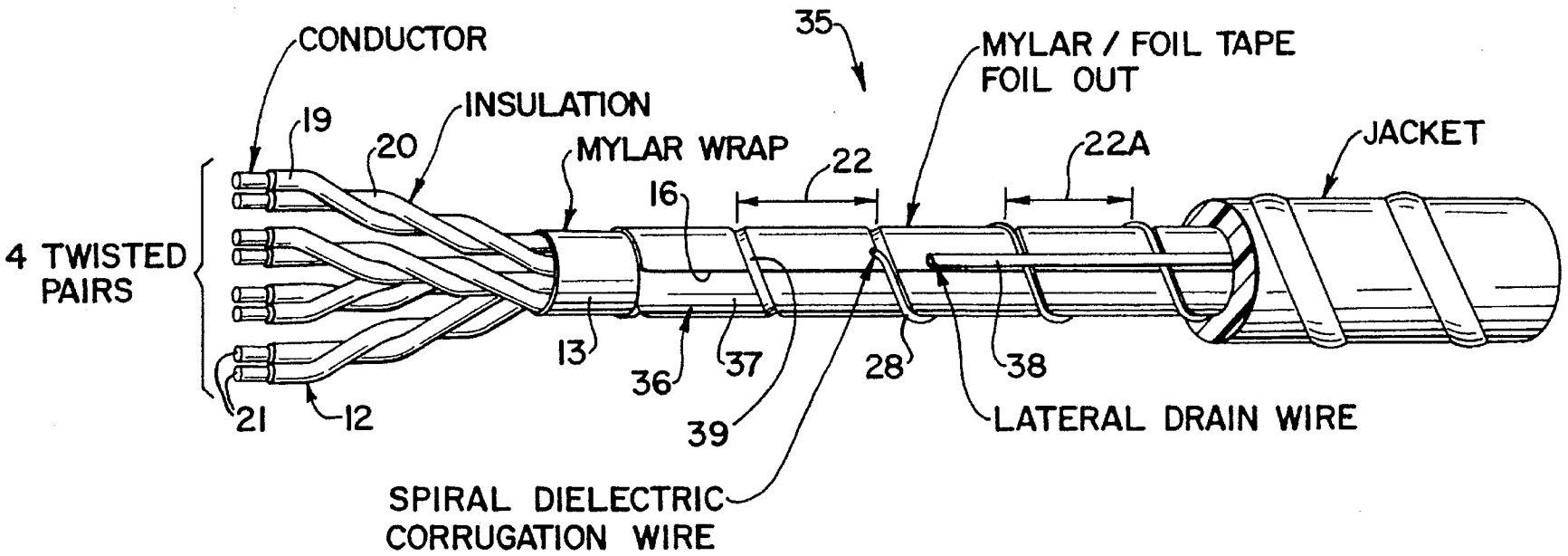
FIG. 6 is a side perspective view of another embodiment of the present invention.

FIG. 6 shows still another high frequency cable 35 made according to the present invention having four Belden Datatwist 350 twisted pair conductors 12, a plastic wrap 13 to group the conductors 12 and form a cable core, a lateral foil shield 37 having overlapping ends that extend longitudinally 16 for substantially the entire length of cable 35, a longitudinally extending metal drain wire 38 in contact with the shield 37, a dielectric cord 28 wrapped around the shield 37 to provide a helical groove 39. The wrap 13 is optional.

The shield 37 is generally a metallic foil tape or a metal-plastic composite foil tape. The tape has a thickness of from about 0.5 to about 4 mils and preferably from about 1 to about 3 mils. The composite foil tape 25 as shown in FIG. 4 is generally prepared by laminating the metal foil 25*a* to a dielectric polymer substrate 25b. The metal foil 25*a* may be aluminum, copper or any of the known conductive shield material used for cables.

The helical groove 39 extends the length of the shield and has groove intervals 22 of from about 0.125 to about 0.75 inches. These grooved intervals preferably are substantially uniform throughout the length of the shield.

The helically wound cord 28 is provided by helically winding the cord around the shield 37 in a sufficiently tight manner to form the helical groove 18. The groove of the drain wire provides a groove having a depth equal to at least 20% of the diameter of the drain wire and preferably at least 50% of the diameter of the drain wire 17. The drain wire 17 is generally a solid cylindrical tinned copper wire. However, it may be made of any suitable conductive material. The drain wire loops have drain wire loop intervals 22A of from about 0.125 to about 0.75 inches.

Figure 7:
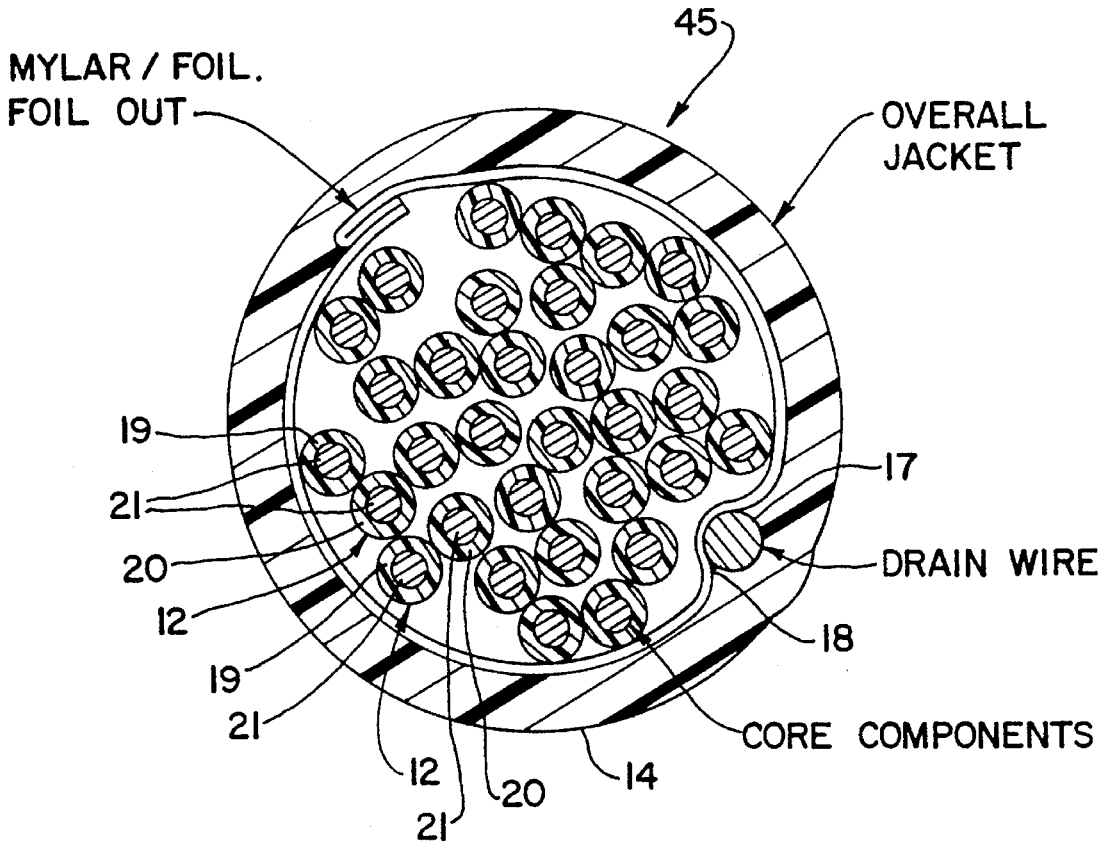
FIG. 7 is an enlarged cross-sectional view of still another embodiment of the present invention.

FIG. 7 illustrates another embodiment of the present invention showing a cable 45 similar to cable 11 except it does not have a wrap 13 (FIG. 1) and it has sixteen twisted pair conductors 12 instead of four. We have placed the same numbers on this figure as we did in FIG. 1 to show that the structure is the same except for the wrap 13 and the number of conductors 12. Therefore, it is not necessary to repeat the description of these items. The depth and interval spacing of the groove is the same as indicated with regard to FIG. 1.

Figure 8A:
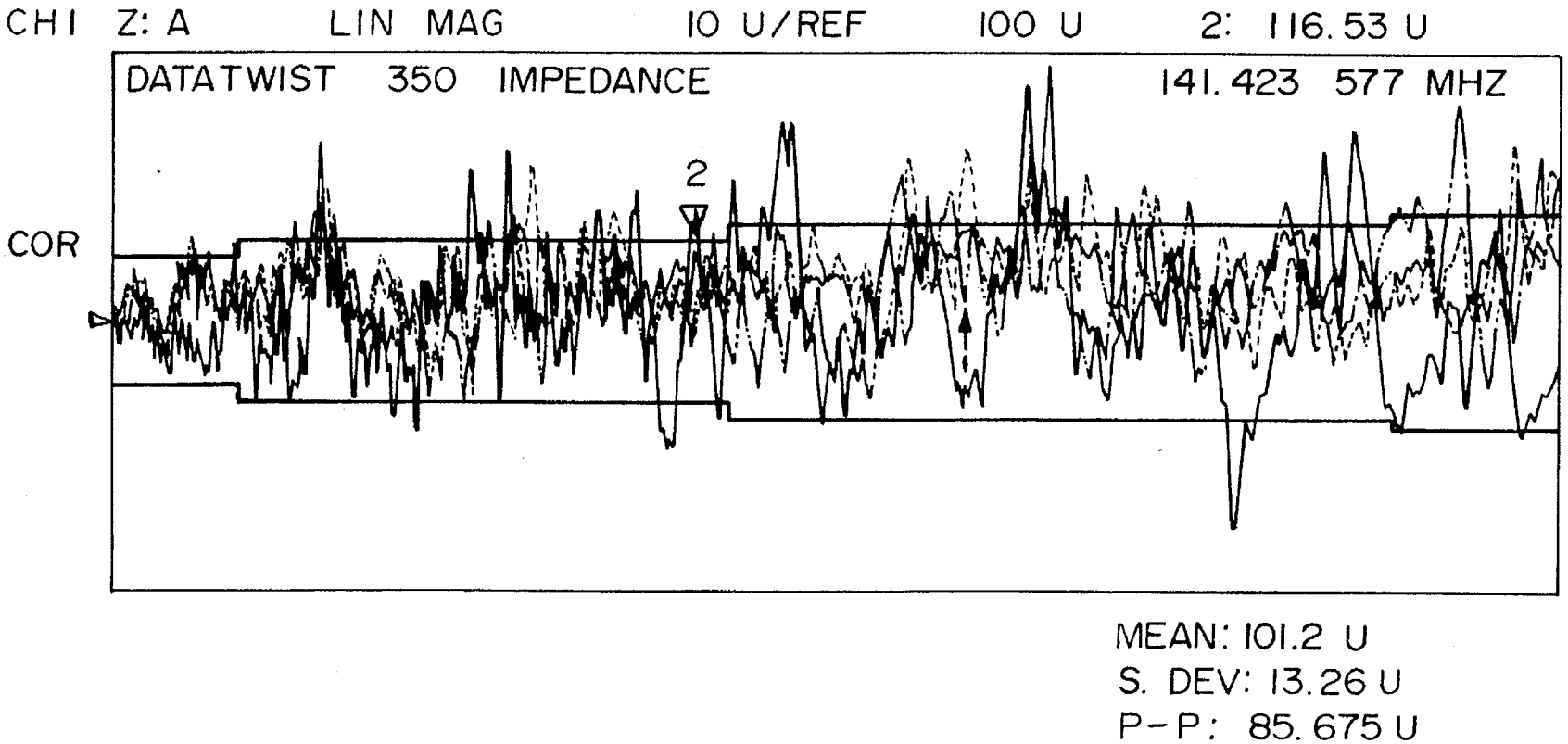
FIG. 8A PRIOR ART
FIGS. 8A to 10B are graphs of cables made in accordance with the prior art.
Figure 9A:
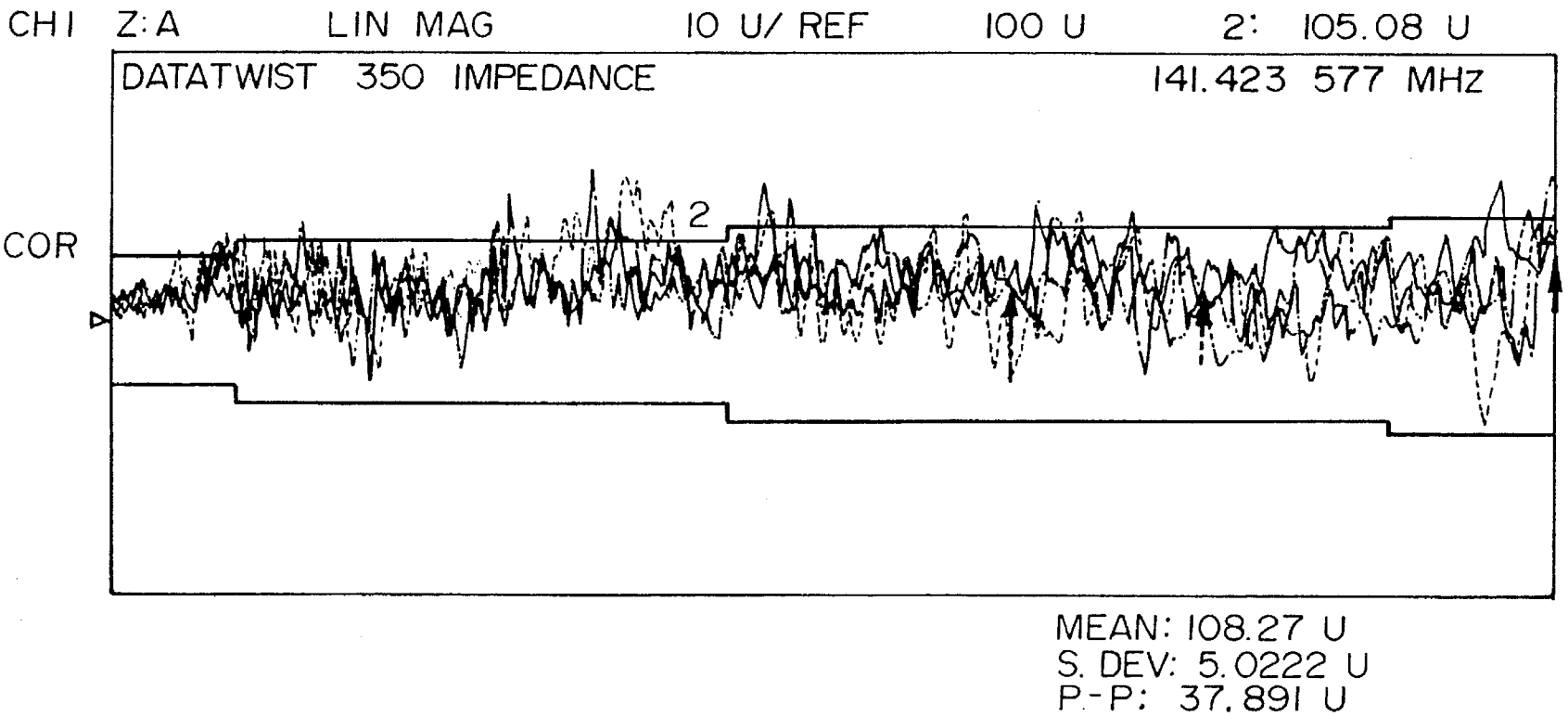
FIG. 9A PRIOR ART
Figure 10A:
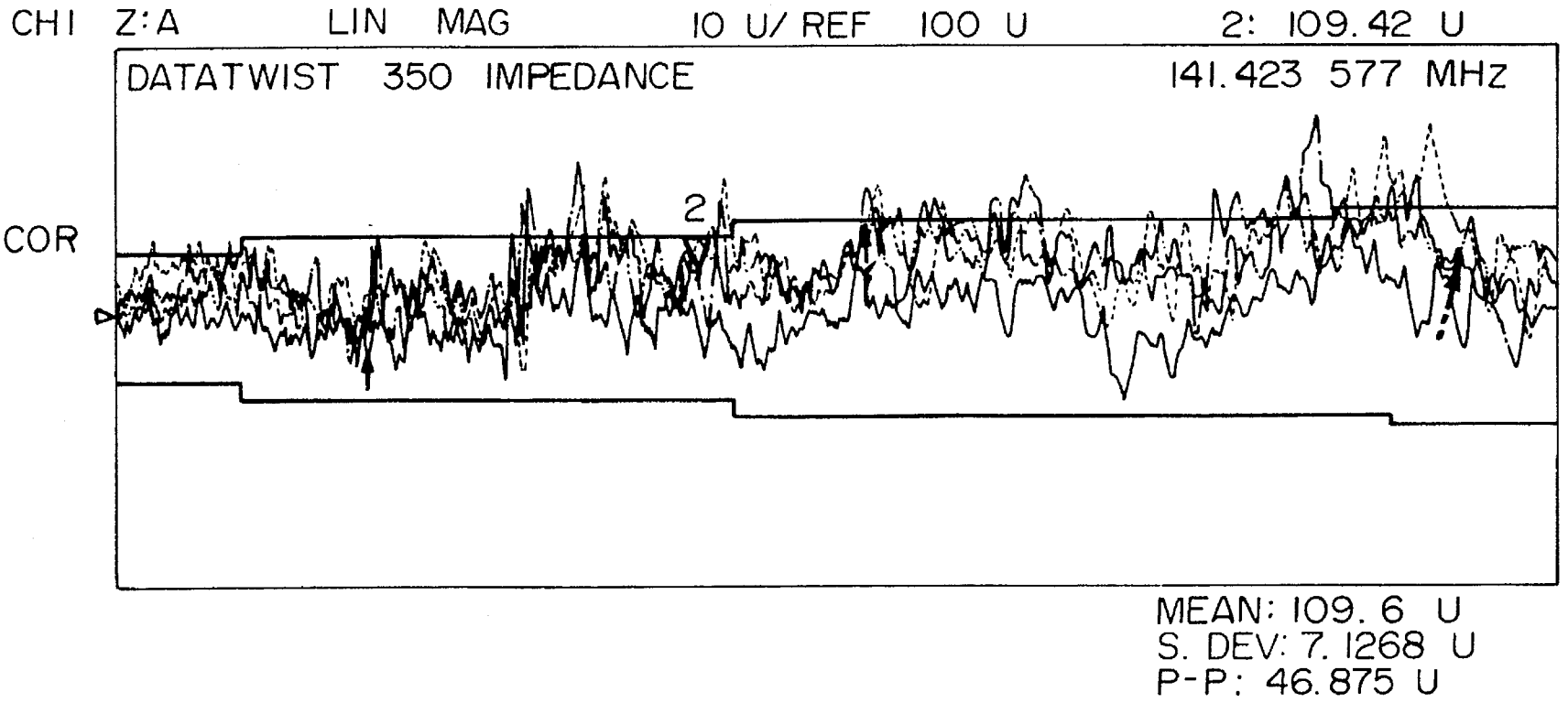
FIG. 10A PRIOR ART

FIGS. 8A, 9A and 10A are graphs of the prior art and demonstrate typical spiral tape with drain shield performance. Impedance is swept from 772 khz to 351 Mhz on the upper graph. The better the cable, the smaller the spread of data from the lowest impedance spike points on the graph to the highest impedance spike points on the graph.

FIGS. 8A, 9A and 10A are graphs of the prior art and demonstrate typical spiral tape with drain shield performance. Impedance is swept from 772 khz to 35 Mhz on the upper graph. The better the cable, the smaller the spread of data from the lowest impedance spike points on the graph to the highest impedance spike points on the graph.

Figure 8B:
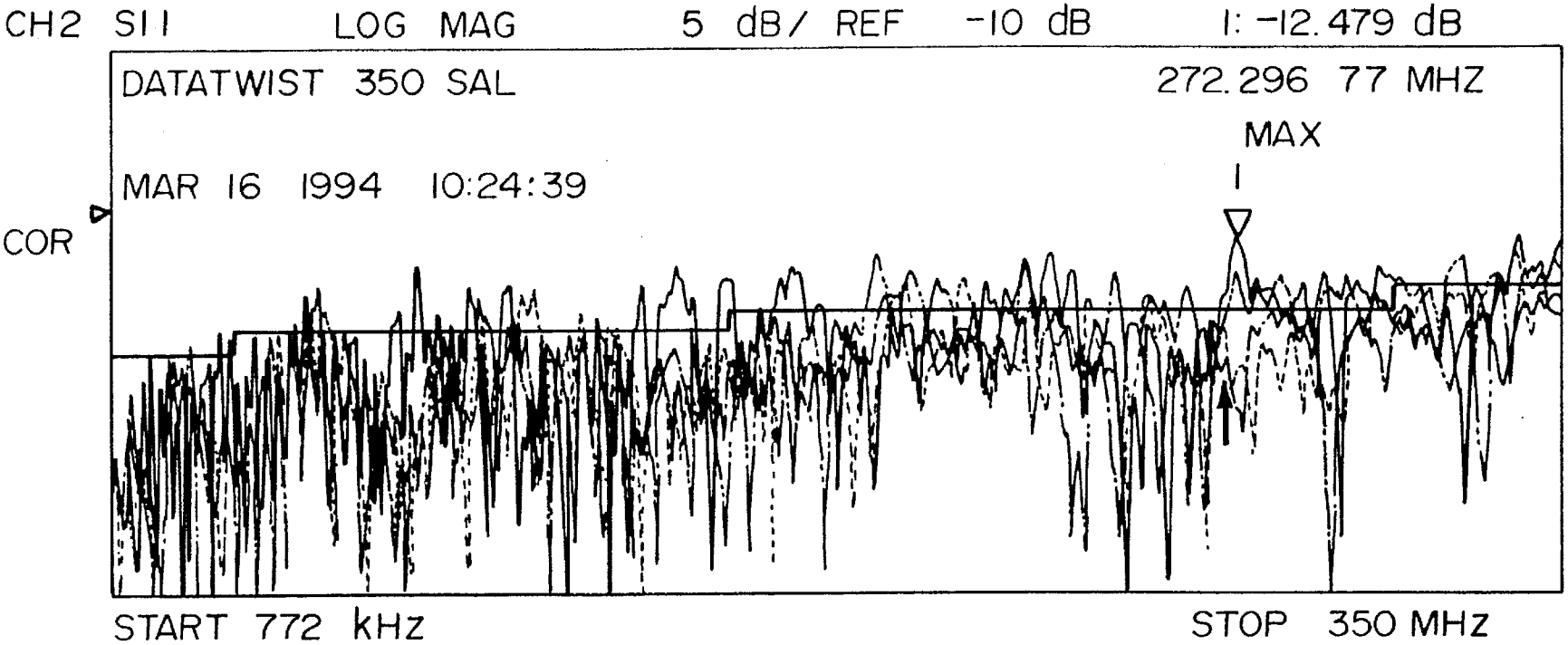
FIG. 8B PRIOR ART
Figure 9B:
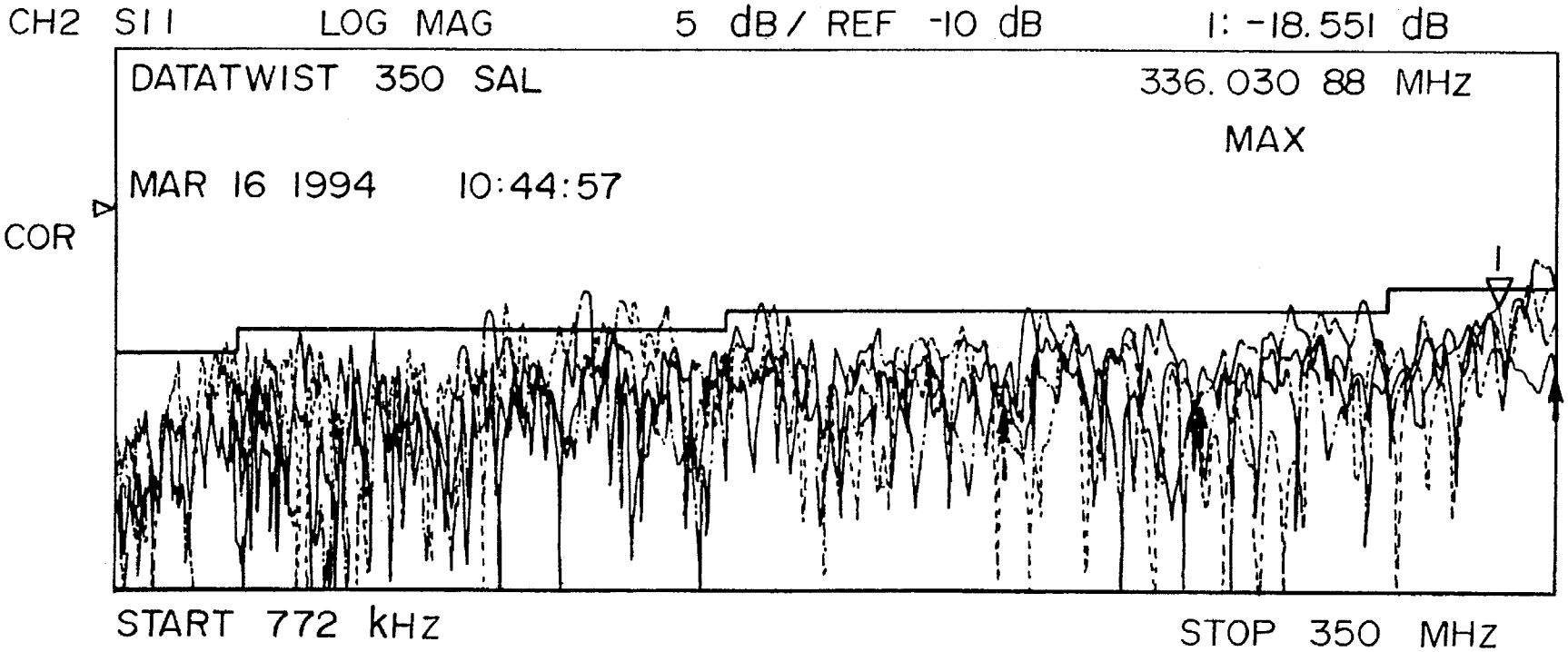
FIG. 9B PRIOR ART
Figure 10B:
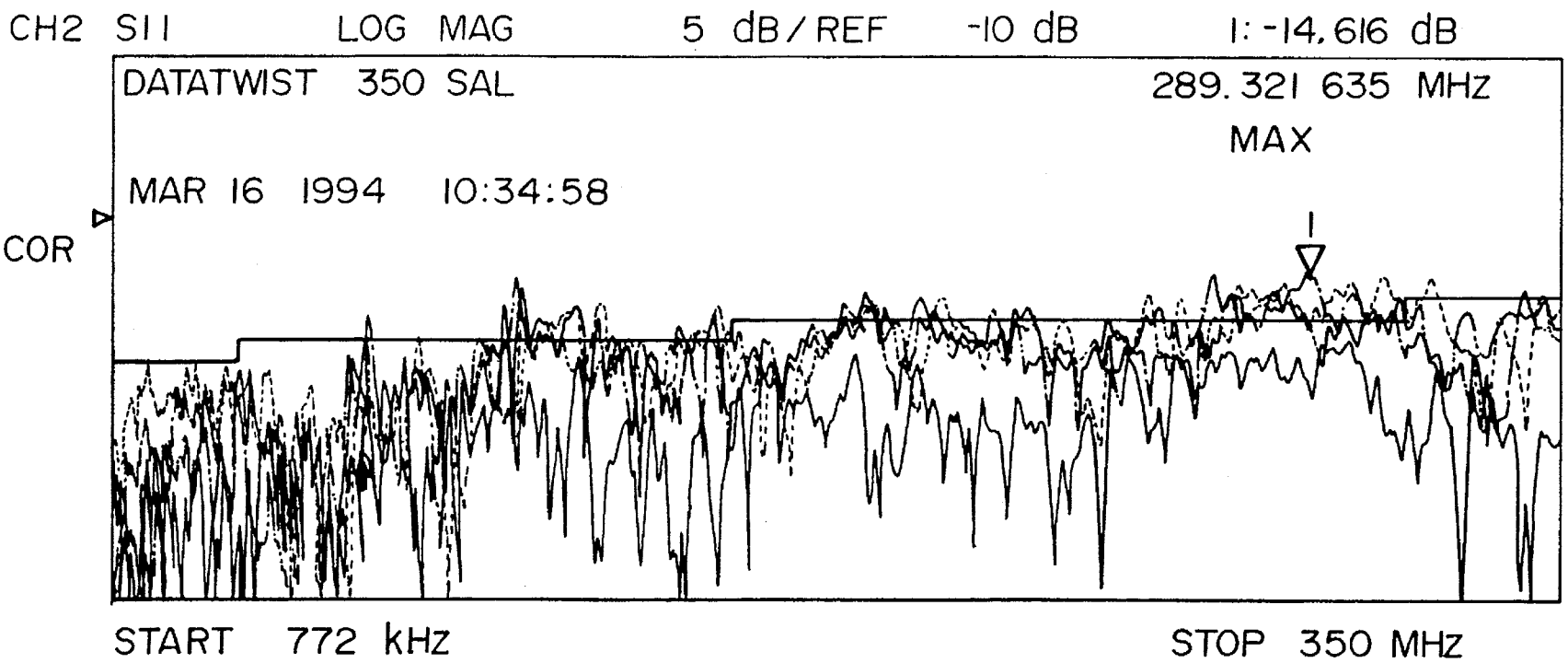
FIG. 10B PRIOR ART
Figure 11A:
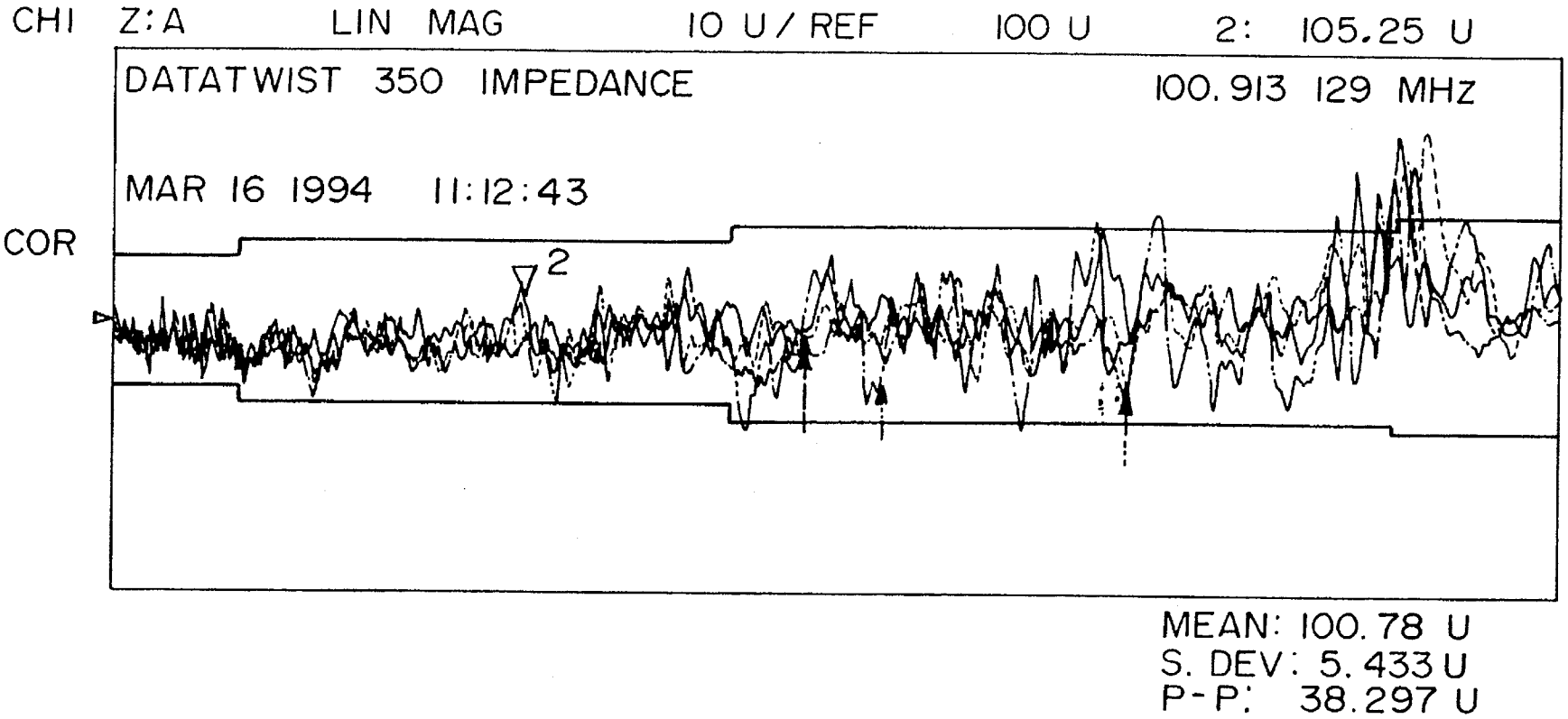
FIG. 11A to 13B are graphs of cables of the present invention.
Figure 11B:
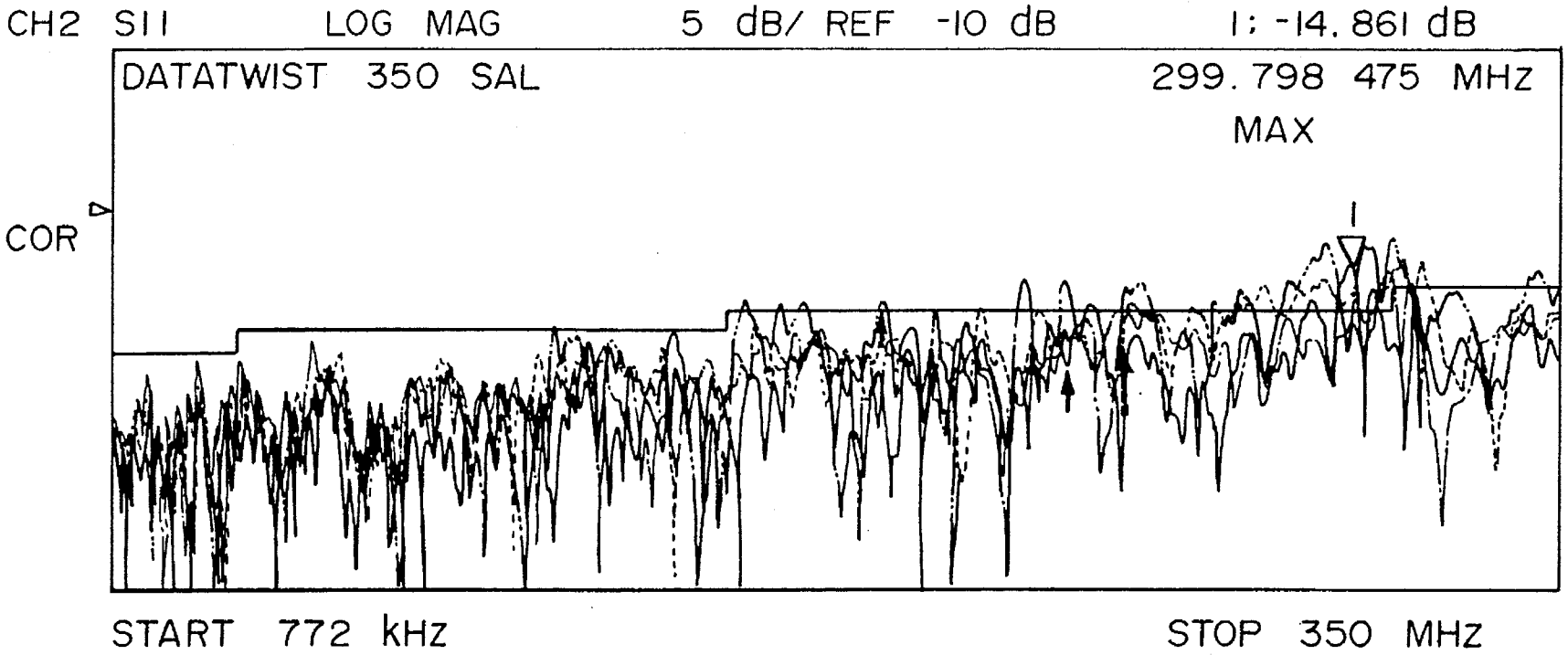
Figure 12A:
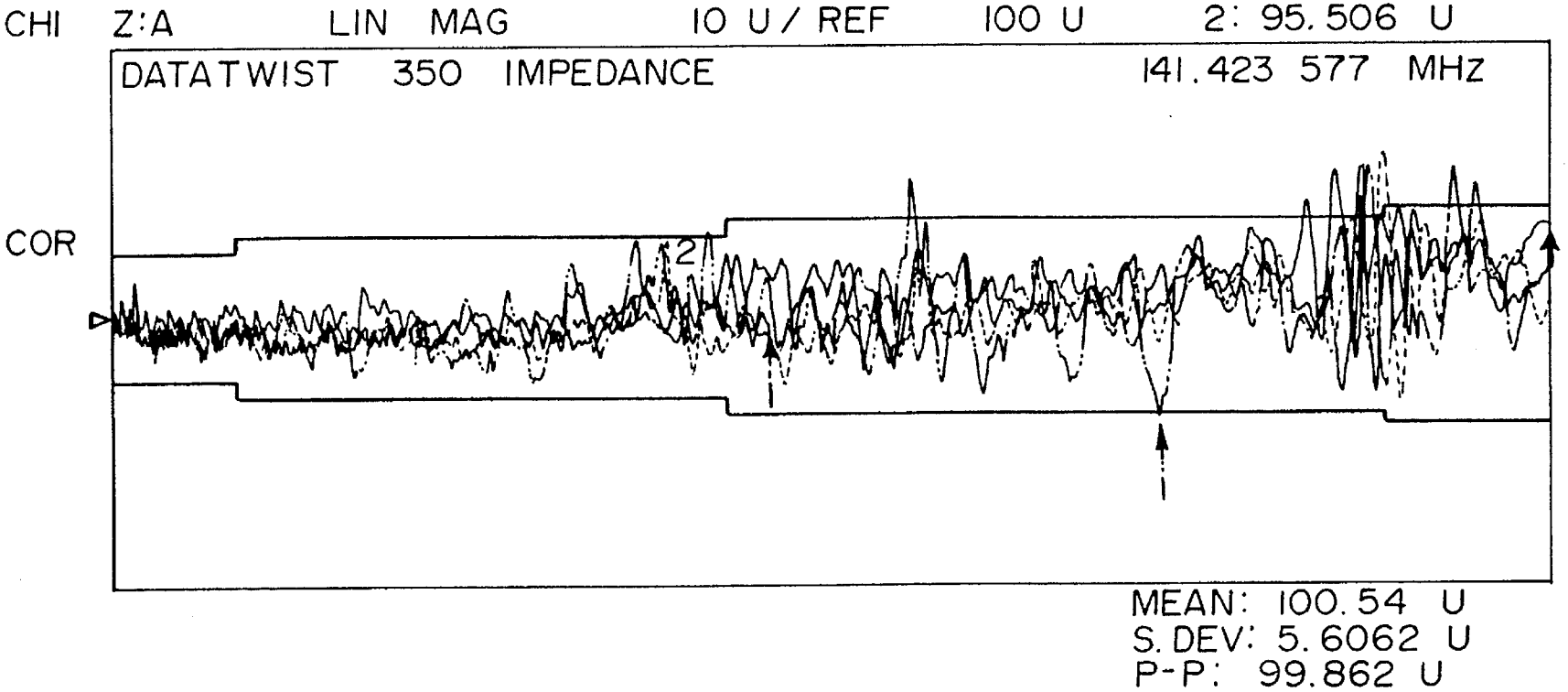
Figure 12B:
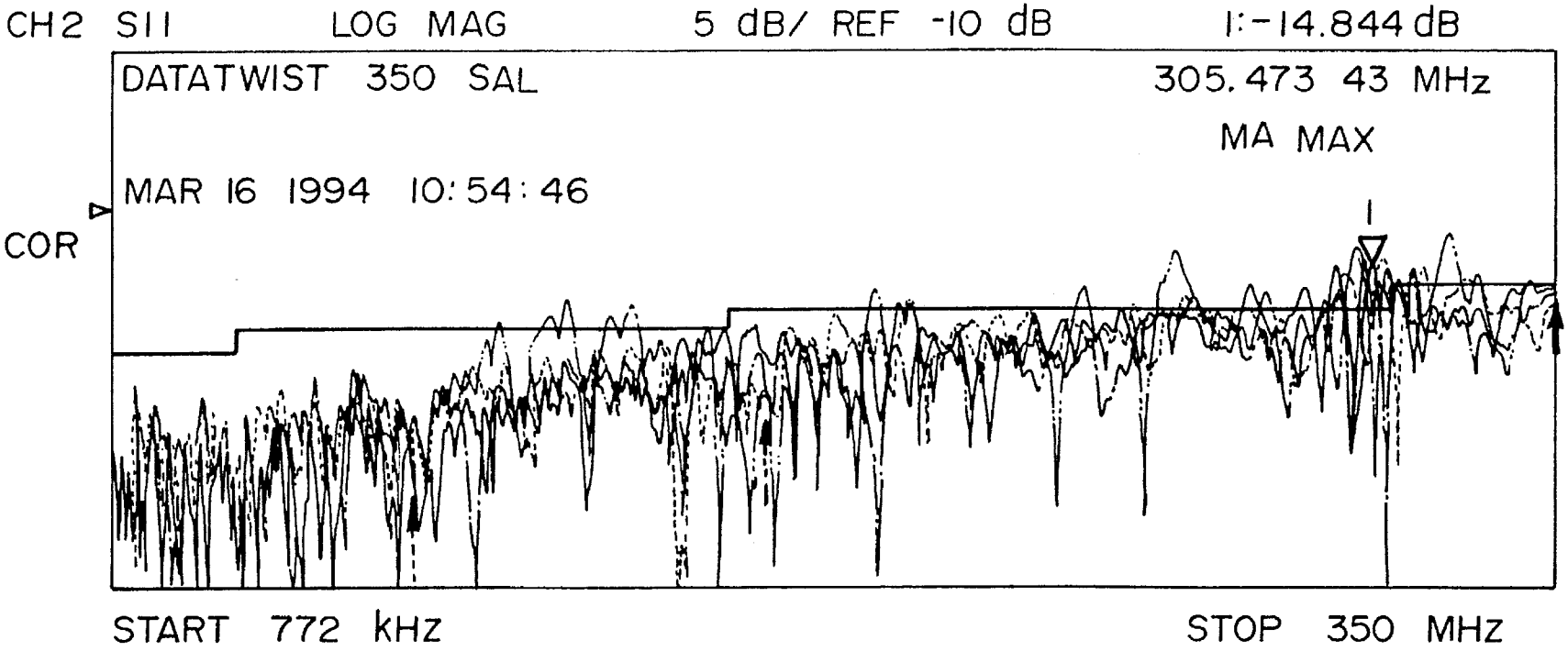
Figure 13A:
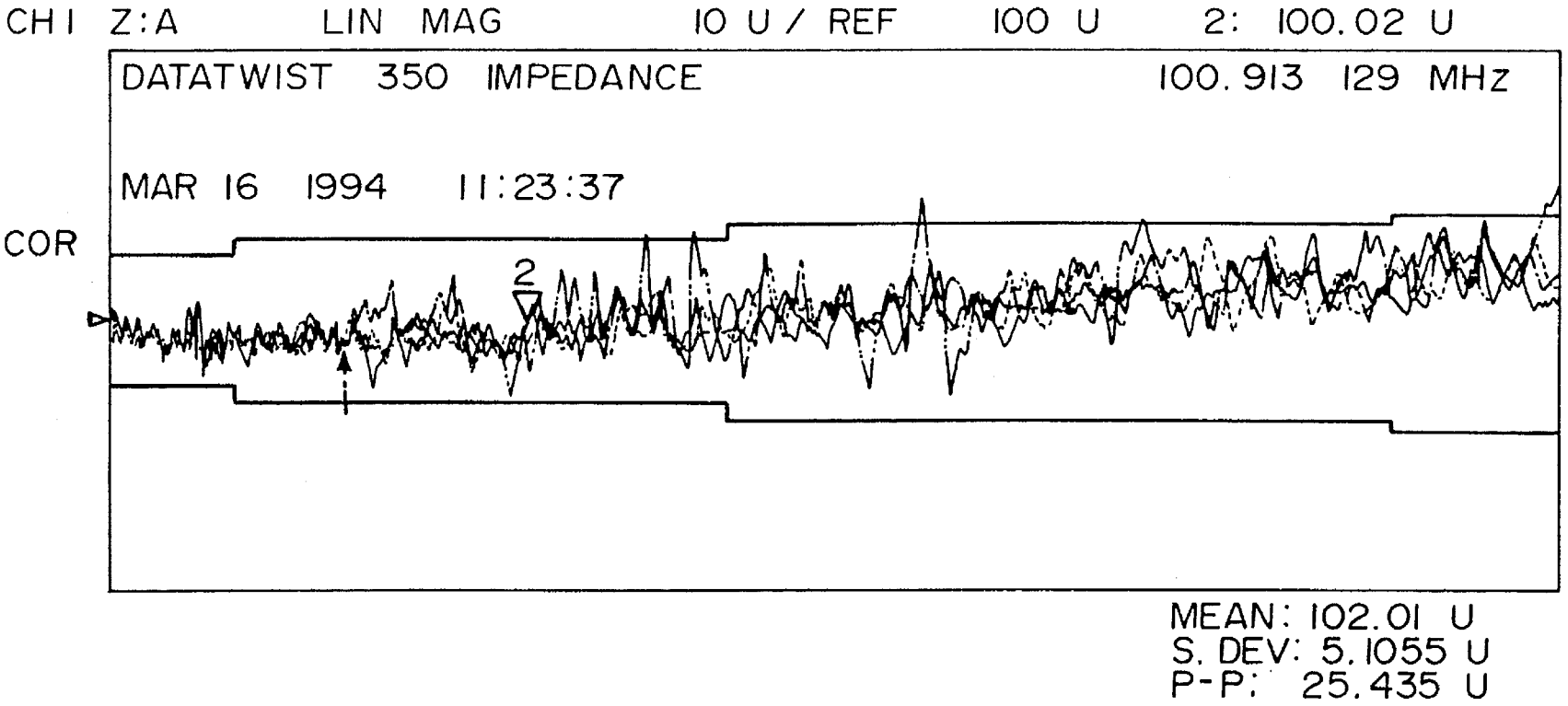
Figure 13B:
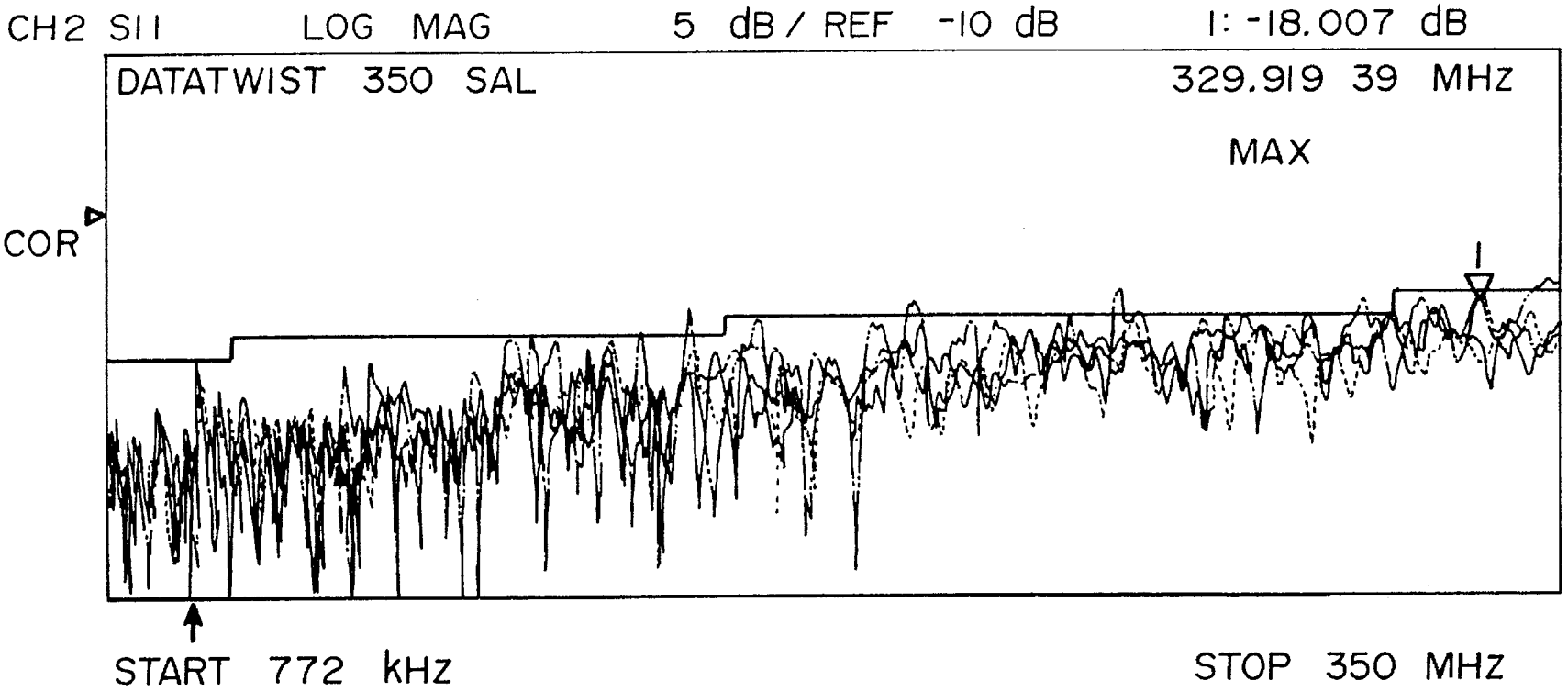

FIGS. 8B, 9B and 10B are corresponding graphs showing the structural return loss (SRL) and are related to impedance performance. The better the impedance stability, which is heavily influenced by shield geometric stability around the core, the better the SRL. The lower the SRL spikes on the graph the better. SRL is also shown from 772 Khz to 350 Mhz.

FIGS. 11A to 13B are corresponding graphs of the present invention and are impedance and SRL graphs of lateral foil tape shield with a helical groove formed by a helical drain wire wrapped around the shield and show a definite improvement over typical spiral shield designs. The impedance graph is much less spread out between minimum and maximum points, and the SRL trace is consistently lower as a result.

The core of the cable may have conductors which are plurality of non-twisted insulated conductors or a plurality of optical fibers for data transmissions. The structure for these are well known to the skilled artisan.

The foregoing description is for purposes of illustration only and is not intended to limit the scope of protection accorded this invention. The scope of protection is to be measured by the following claims, which should be interpreted as broadly as the inventive contribution permits.

I claim:

1. A shielded cable comprising a group of at least four twisted pair insulated wires;

a lateral shield having overlapping longitudinal ends surrounding said group of at least four twisted-pair insulated wires, said shield having a thickness of about 1 to about 4 mils, said shield having a conductive metal foil on one surface and a non-conductive plastic on an opposite surface;

a drain wire extending the length of said cable and being in contact with said conductive metal face, a helical groove formed in said shield; and an insulating jacket surrounding said shield.

2. The cable of claim 1 wherein said metal conducting metal foil is aluminum or an aluminum alloy.

3. The cable of claim 2 wherein said conducting metal foil faces said jacket and said drain wire helically wraps around said shield and provides said helical groove.

4. The cable of claim 2 wherein said conducting surface faces said at least four twisted-pair insulated wires; and a nonconducting substantially cylindrical cord helically wrapped around said shield to provide said helical groove.

5. The cable of claim 3 wherein the depth of said helical groove is at least 20% of the diameter of said drain wire.

6. The cable of claim 4 wherein the depth of said helical groove is at least 50% of the diameter of said cord.

7. The cable of claim 1 wherein said helical grooves are spaced at intervals of from about 0.125 inches to about 0.75 inches.

8. A shielded cable comprising at least one twisted pair of insulated wires, a drain wire, a longitudinal overlapping lateral shield surrounding said at least one twisted pair of insulated wires, said shield having a conductive metal surface, said shield having a helical groove and said groove has a depth of at least 20% of the diameter of said drain wire and an insulating jacket surrounding said shield.

9. The shielded cable of claims 8 wherein said groove has a depth of at least 50% of the diameter of said drain wire.

10. The shielded cable of claim 9 wherein said drain wire provides the helical groove in the shield.

11. The shielded cable of claim 9 wherein the helical groove has groove intervals spaced apart from about 0.125 inches to about 0.75 inches.

12. The shielded cable of claim 11 wherein said shield has a metal conductive surface and an opposite non-conductive plastic surface, said drain wire is in electrical contact with said metal conductive surface, and said drain wire provides the helical groove.

13. The shielded cable of claim 12 wherein said shield has a thickness of about 1 to about 4 mils, said conductive surface faces said jacket and said drain wire is helically wrapped around said shield for the entire length of said cable to provide said helical groove which extends the entire length of the cable.

14. The shielded cable of claim 11 wherein said shield has said conductive metal surface and an opposite non-conductive surface, said conductive metal surface facing said at least one twisted pair of insulated wire, a non-conductive cylindrical cord helically wrapped around said shield for the entire length of said cable to provide the helical groove which extends the entire length of the cable, and said shield having a thickness of from about 1 to about 4 mils.

15. The shielded cable of claim 8 wherein said conductive metal surface faces said jacket, said helical groove is formed by a dielectric cord helically wrapped around said shield, and said drain wire extends longitudinally,

16. The shielded cable of claim 8 wherein there is a first and second group of at least four twisted pairs of insulated wires, a first shield having overlapping longitudinal ends surrounding said first group of at least four twisted pairs of insulated wires, a second shield overlapping longitudinal ends surrounding said second group of at least four twisted pairs of insulated wires, each first and second shield having a conductive metal surface and a helical groove, said insulating jacket surrounding said first and second .shields, a first drain wire contacting the conductive metal surface of said first shield and a second drain wire contacting the conductive metal surface of said second shield.

17. The cable of claim 16 wherein the helical groove of said first shield is formed by a first non-conducting cord helically wrapped around said first shield and has first groove intervals spaced apart from about 0.125 inches to about 0.75 inches.

18. The cable of claim 17 wherein the helical groove of said second shield is formed by a second non-conducting cord helically wrapped around said second shield and has second groove intervals spaced apart from about 0.125 inches to about 0.75 inches.

* * * * *

UNITED STATES PATENT AND TRADEMARK OFFICE

CERTIFICATE OF CORRECTION

PATENT NO. : 5,486,649

DATED : January 23, 1996

INVENTOR(S) : Galen M. Gareis

It is certified that error appears in the above-identified patent and that said Letters Patent is hereby corrected as shown below:

Column 1, line 49, delete "lit" and insert --it--.
Column 2, line 1, delete "Of" and insert --of--.
Column 6, line 12 delete "351" and insert --35--.
Column 6, lines 16 thru 21, should be deleted.
Column 8, line 10, delete "," and insert --.--.
Column 8, line 22, delete ".".

Signed and Sealed this

Thirtieth Day of July, 1996

*Attest:*

*Attesting Officer*

BRUCE LEHMAN

*Commissioner of Patents and Trademarks*